US005408904A

United States Patent [19]

Neff

[11] Patent Number: 5,408,904

[45] Date of Patent: * Apr. 25, 1995

[54] QUICK-ADJUSTABLE AND LOCKING TOOL

[76] Inventor: Ted Neff, 24701 Raymond Way, #115, Lake Forest, Calif. 92630-4721

[ * ] Notice: The portion of the term of this patent subsequent to Jan. 5, 2010 has been disclaimed.

[21] Appl. No.: 167,625

[22] Filed: Dec. 14, 1993

Related U.S. Application Data

[63] Continuation-in-part of Ser. No. 89,764, Jul. 7, 1993, abandoned.

[51] Int. Cl.[6] ..... B25B 7/12

[52] U.S. Cl. ..... 81/360; 81/319; 81/322

[58] Field of Search ..... 81/319, 322, 360

[56] References Cited

U.S. PATENT DOCUMENTS

| | | | |
|---|---|---|---|
| 1,110,220 | 9/1914 | Millsap | 81/319 X |
| 2,595,989 | 5/1952 | Smeltz | 81/322 X |
| 3,283,624 | 11/1966 | Neff | 81/360 |
| 3,357,287 | 12/1967 | Wertepny | 81/322 |
| 5,176,049 | 1/1993 | Neff | 81/360 |

*Primary Examiner*—James G. Smith

[57] ABSTRACT

A hand tool that is automatically self-adjusting by alternately squeezing and relaxing the hand grid on the two handles; that has constantly parallel jaws at any adjustment; that actually grips the work object with at least an 8-to-1 compound gripping leverage; and that can be locked onto an object when desired with a selectively light or strong grip. All of the operations, except the resetting the adjustable jaw to a wide open position, can be done with just the hand holding the tool and it can be made in the form of an adjustable plier, an adjustable wrench, or an adjustable pipe wrench, plus many other applications.

20 Claims, 2 Drawing Sheets

QUICK-ADJUSTABLE AND LOCKING TOOL

This is a CIP of 08/089,764, filed Jul. 7, 1993, abandoned.

FIELD OF THE INVENTION

This invention relates to hand tools in general, and more particularly to a tool that grips a work object, is automatically self-adjusting, can be locked on the work object easily and quickly, and can be released from the locked position just as easily and quickly.

BACKGROUND

This invention is an improvement over the hand tools contained in U.S. Pat. No. 5,176,049 issued to applicant on Jan. 5, 1993, entitled "COMPOUND LEVERAGE GRIPPING TOOL WITH CONSTANTLY PARALLEL JAWS".

The improvement consists of a combination of all the outstanding features contained in the above referenced documents to provide a single tool having all of those features as follows: (a) can be adjusted quickly and automatically; (b) constantly parallel jaws; (c) can be used in a fast, ratchet-like manner; (d) can be locked on an object very simply and effectively; and (e) can automatically be released from a locked position by just squeezing the two handles.

A locking tool and numerous copies of it have been on the market for over 50 years, but they have a number of disadvantages not present in the instant invention. The dominant locking tool is contained in U.S. Pat. No. 2,280,005, issued to Petersen Apr. 14, 1942. The locking means utilized in the present invention is superior to that used by Petersen and his copiers as will be obvious from the description and claims presented herein.

The first of these disadvantages is the manner in which the jaws are adjusted to an object. In making such an adjustment, a threaded screw is located in the extreme end of one of the handles. In order to adjust the jaws to an object, this screw must be turned inward to widen the jaw gap and outward to narrow the jaw gap, a procedure that must be done several times before the proper jaw gap is obtained. For every object of a different size, the jaws must be adjusted precisely in order for the locking operation to satisfactorily take place. This results in a tedius and time-consuming operation.

A second disadvantage occurs when the tool is adjusted so that the lock is extremely tight on a work object. When this occurs, it is very difficult to squeeze the release mechanism hard enough to effect the release, and very often the handles fly apart very abruptly and can injure the user's fingers and cause him to drop the tool.

A third disadvantage lies in the fact that the tool is difficult, if not impossible, to use as common ordinary pliers or wrench because the spring attached to the pivoting adjustable jaw and to the handle containing the fixed jaw urges the handles to spring apart and spread the jaws out of position for the job at hand as the jaws cannot maintain a fixed opening without being locked. This feature not only is frustrating to the operator, but is also time-consuming.

Other attempts have been made to eliminate the screw adjustment of the basic patent issued to Petersen, but they have all been failures as the Petersen tool is still the predominent tool in this field after more than fifty years. For example, the U.S. Patent issued to Westby etal, U.S. Pat. No. 3,208,319, Sep. 28, 1965, which has a large number of parts that would be difficult to make and assemble, plus having a cam lever or an adjusting screw projecting outwardly from one or the other of the two handles, presenting a very uncomfortable grip for the user.

Another example is U.S. Pat. No. 3,793,914, Feb. 26, 1974, issued to Helms, which has a finger tab 43 projecting outwardly from one of the handles, presenting the same problem as the Westby etal invention.

Another disadvantage found in all three of the inventions discussed above is that they all have jaws that "scissor" in order to open and close them on an object, which means that there is only one point in the adjustment range of the jaws where they are parallel to each other in the optimum gripping position.

As can be seen, no such proliferation of parts or disadvantages exist in the present invention.

Accordingly, several objects and advantages of the present invention are to provide:

(a) a hand tool that can be operated with a fast, ratchet-like action without the use of a standard ratchet mechanism, and which can be locked on an object of round, square, hexagonal, or irregular shape;

(b) a hand tool of various jaw configurations having a compound gripping leverage ratio of at least 8-to-1;

(c) a hand tool that has jaws which are always in parallel alignment throughout their entire adjustment range;

(d) a hand tool that automatically adjusts the jaw gap by the squeezing and relaxing of the grip pressure on the handles;

(e) a hand tool whose jaws can easily be locked on an object with either a light or a strong grip at the choice of the operator with just a flick of the thumb of the hand holding the tool;

(f) a hand tool that can be released from said locked position automatically by just squeezing the two handles together;

(g) a hand tool that can be operated as an ordinary plier or wrench without interference or problems caused by the adjusting, locking, or releasing mechanisms; and (h) a hand tool as described that can be produced and sold economically to a wide spectrum of the population.

Other objects and advantages appear in the combination of the elements, arrangement of the various parts, and unique features of construction and usage which will be pointed out more fully hereinafter and disclosed in the accompanying drawings and detailed description wherein some preferred forms of the invention are presented.

It will be understood that these preferred forms are for illustration purposes only and the invention is not necessarily limited to such, but may be adapted and used for any purpose for which it is found to be suitable.

DETAILED DESCRIPTION

Figure 1:
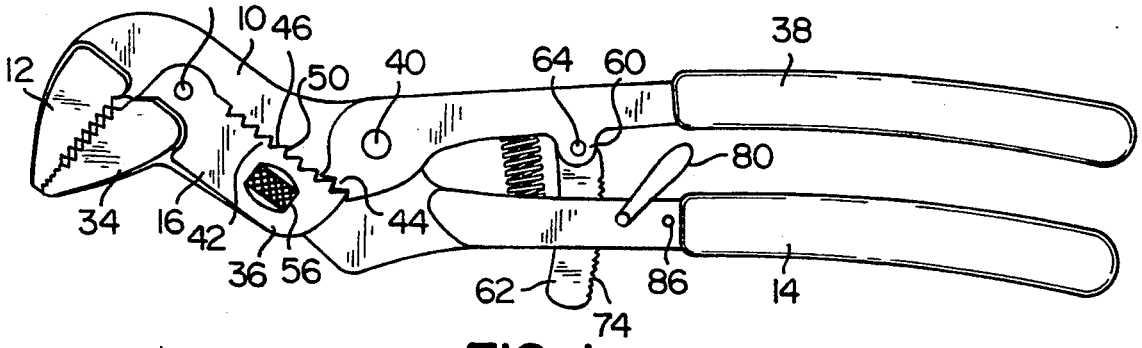
FIG. 1 is a plan view of the front side of a first preferred embodiment in the form of a plier having serrated jaws with the gripping jaws fully closed and the locking pawl engaged.
Figure 2:
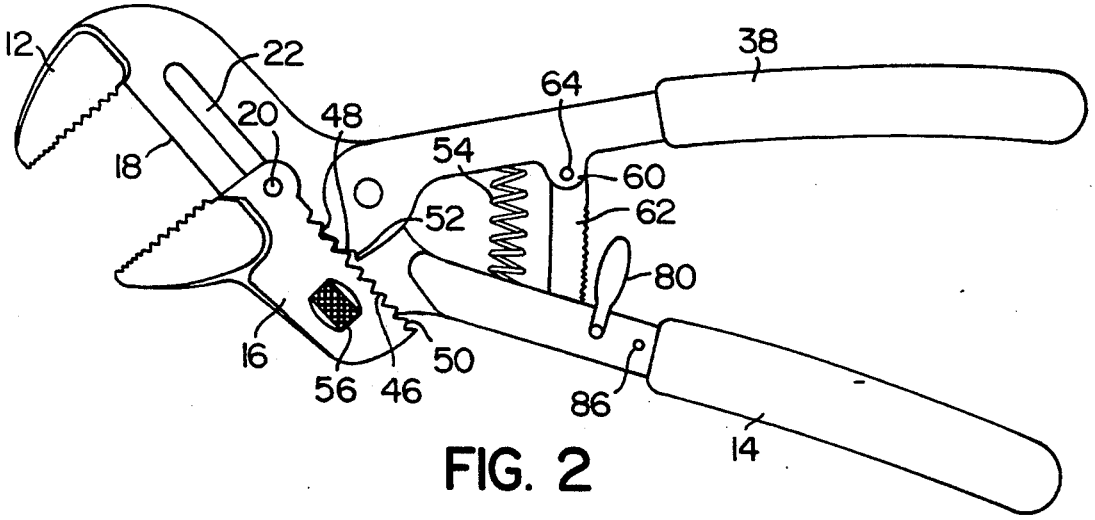
FIG. 2 is a plan view of the tool in FIG. 1 with the gripping jaws fully open and the locking pawl disengaged.
Figure 3:
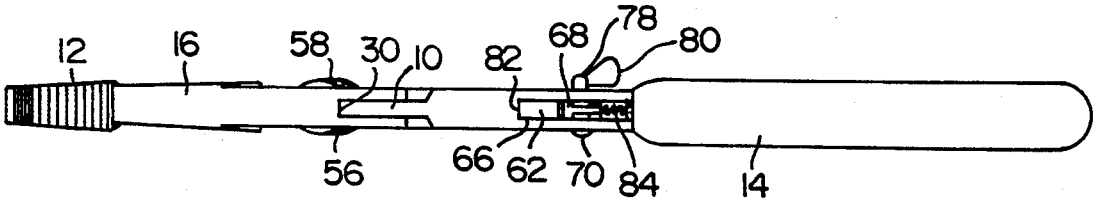
FIG. 3 is a plan view of an edge, or bottom side, of the tool as shown in FIG. 2.

In the drawings:

FIGS. 1, 2, and 3 show one of the preferred embodiments of the invention in the form of a pliers having a body 10, a fixed serrated jaw 12, and a fixed handle 14. A bifurcated adjustable jaw 16 straddles a rail section 18 on body 10, and is held thereon by a pin 20. Pin 20 is attached to adjustable jaw 16 and is slidably mounted in an elongated slot 22.

A leaf spring 24 is attached by a lower end 26 to an inner wall 28 of a bifurcated section 30 on adjustable jaw 16, and its upper end 32 bears forcefully against rail section 18, pushing the upper portion 34 of adjustable jaw 16 away from rail section 18 and the lower portion 36 toward gear teeth 44 on pivoting handle 38. Spring 24 also holds jaw 16 in a stationary position by frictional contact with rail 18 until moved by the pivoting of handle 38 or until jaw 16 is pulled away from rail 18 to reposition jaw 16 away from fixed jaw 12.

Pivoting handle 38 is bifurcated in a similar manner to jaw 16 and straddles body 10, being held thereon by a pivot pin 40. A jacking action that quickly moves jaw 16 toward jaw 12 is accomplished by the shade of gear teeth 42 on adjustable jaw 16 and gear teeth 44 on pivoting handle 38. Both sets of gear teeth have long flat sides 46 and 48, and shorter flat sides 50 and 52. As pivoting handle 38 is moved away from fixed handle 14, the long flat sides 48 on gear teeth 44 slide down the long flat sides 46 on gear teeth 42 while the adjustable jaw 16 is held stationary by the friction of spring 24 against rail section 18 until gear teeth 42 and 44 are reengaged at a lower position on adjustable jaw 16. The pivoting of handle 38 back toward handle 14 brings short sides 50 and 52 into contact and, because of their relatively obtuse angle in relation to rail section 18, remain engaged until the movement of handle 38 is again reversed, thereby moving adjustable jaw 16 toward jaw 12 in a series of jacking movements. This action is repeated rapidly and closes jaws 16 and 12 on an object very quickly in just a few seconds.

The travel of pivoting handle 38 away from fixed handle 14 is limited by the length of spring 54 between the two handles and by the depth of the bifurcation in handle 38 so that the jaws of the tool will not inadvertently change their gap adjustment if the tool is temporarily laid down during a pause in the job at hand.

To reset adjustable jaw 16 to an open position in relation to fixed jaw 12, raised knobs 56 and 58 are grasped and the lower portion of jaw 16 is pulled outward and downward in a single motion which disengages gear teeth 42 and 44. While disengaged, jaw 16 may be set at any point between the top and bottom of its travel within the confines of elongated slot 22 and reengaged at the option of the user.

Figure 4:
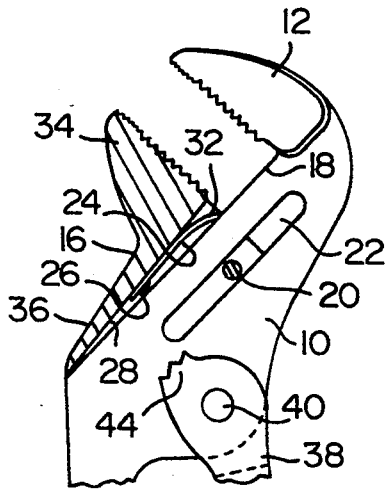
FIG. 4 is a portion of the first preferred embodiment with the adjustable jaw in section and the handles cut away.

FIG. 4 shows the internal construction of the adjustable jaw 16 and the position of the leaf spring 24 attached to inner wall 28 of the bifurcated section.

Figure 5:
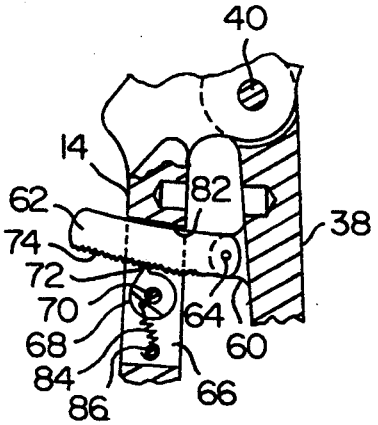
FIG. 5 is another portion of the tool of the first preferred embodiment, partly in section, showing the locking mechanism unlocking with the jaws and handles cut away.

FIG. 5 shows the mechanism and parts thereof that perform a preferred locking and unlocking operation. A yoke 60 extends outwardly from pivoting handle 38. An arm 62 is attached to yoke 60 and held in place by a pin 64. Arm 62 extends freely through a channel 66 in fixed handle 14. A pawl 68 is disposed within channel 66 and pivotably held in position by a pin 70. Pawl 68 has a tooth 72 which is manually engaged with serrations 74 on one edge of arm 62 by turning lever 80 in a clockwise direction. This action locks arm 62 tightly between pawl 68 and wall 82 of channel 66. A spring 84 has one end attached to pawl 68 and the other end to a pin 86 in handle 14 and is biased to pull bawl 68 in a counterclockwise direction to keep pawl 68 from inadvertently engaging serrations 74 during the normal usage of the tool. Spring 84 is also used to release jaws 12 and 16 from a locked position on an object. This is accomplished by again squeezing handles 14 and 38 tightly together and releasing the frictional contact between Pawl 68 and serrations 74, thereby activating spring 84 which pulls pawl 68 out of contact with serrations 74.

Figure 6:
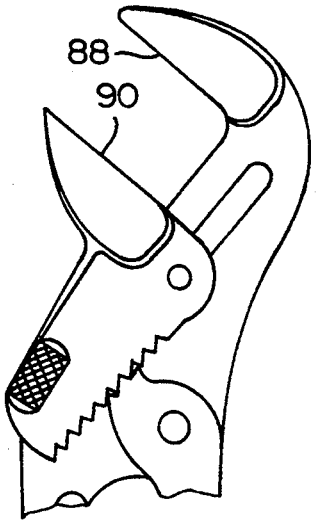
FIG. 6 shows a portion of a second preferred embodiment in the form of an adjustable wrench having straight smooth jaws, with the handles cut away.

FIG. 6 shows a portion of a second preferred embodiment of the invention in the form of an adjustable wrench having straight smooth jaw gripping surfaces 88 and 90 primarily for use in turning nuts and bolts.

Figure 7:
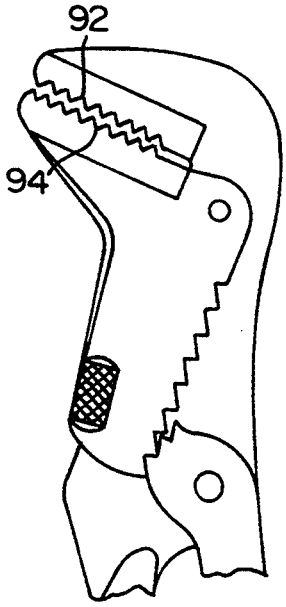
FIG. 7 shown in a portion of a third preferred embodiment of the invention in the form of a pipe wrench, with the handles cut away.

FIG. 7 shows a portion of a third preferred embodiment of the invention as applied to an adjustable pipe wrench having pipe gripping jaw surfaces 92 and 94 distinguished by much larger teeth than those of the plier embodiment. In this embodiment, the tool can automatically be adjusted to any pipe, pipe connection, or other object within its jaw capacity and operated with the same advantages offered by the other preferred embodiments presented herein. As far as is known or can be determined, no other pipe wrench is capable of being operated in this manner.

Figure 8:
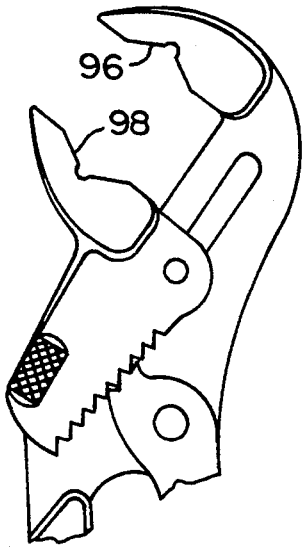
FIG. 8 shows a portion of a fourth preferred embodiment of the invention as applied to a wrench having V-shaped jaws, with the handles cut away.

FIG. 8 shows a fourth preferred embodiment of this invention with the jaws 96 and 98 in the form of opposing V's with the corners having small radiused recesses to prevent the jaws from contacting the corners of hexagonal fittings, especially those made of materials that are softer than steel such as brass, copper, aluminum, and plastic.

All of the actions required to adjust the various embodiments of the tool rapidly to an object, lock the jaws on an object, and release the jaws from the locked position can be accomplished with just the hand holding the tool. The only operation requiring the use of a second hand is the opening of the jaws, which can be done very quickly in about one second.

OPERATION OF THE ADJUSTING MECHANISM

The adjustable jaw can be jacked toward the fixed jaw to grip an object in increments of one, two, or three gear teeth at a time by hooking the fixed jaw over the object and controlling the distance the pivoting handle is pivoted outward away from the fixed handle. A short distance will move the adjustable jaw one gear tooth closer to the fixed jaw, a medium distance will move it two gear teeth closer, and a longer distance will move it three gear teeth closer at the option of the operator, depending on the size of the work to be gripped. For example, a larger item with the jaws in the widest jaw gap will not need any adjustment by the jacking action, a slightly smaller object may require one gear width of movement, a medium-sized object may require two or three gears of movement, all of which can be done with just one swing of the pivoting handle. For smaller objects, two swings of the pivoting handle will be required to cover 4, 5, and 6 gear teeth, and finally, three swings will be required to move the adjustable jaw 7 and 8 gear teeth. These movements may all be done very rapidly.

OPERATION OF THE LOCKING MECHANISM

The locking mechanism is activated by first adjusting the adjustable jaw against the work object as described above. The handles are then squeezed tightly together and the locking pawl, by means of the pawl lever, is engaged with the serrations on the locking arm with the thumb of the hand holding the tool and the handles are then released. The jaws will remain locked tightly on the work object until the release mechanism is activated by again squeezing the handles tightly together which permits the pawl spring to pull the pawl out of engagement with the serrations on the locking arm.

I claim:

1. A hand tool comprising a body having an integrally formed fixed jaw and fixed handle;

an adjustable jaw and a pivoting handle attached to said body;

means for mounting said adjustable jaw slidably and pivotally on said body;

means for facilitating the adjustment of said adjustable jaw rapidly toward said fixed jaw; and means for facilitating the adjustment of said adjustable jaw rapidly away from said fixed jaw, said means of adjustment being accomplished while at the same time maintaining constantly parallel alignment between said adjustable jaw and said fixed jaw.

2. The hand tool of claim 1, wherein said fixed jaw and said adjustable jaw have gripping surfaces thereon.

3. The hand tool of claim 2, wherein said gripping surfaces have a series of teeth thereon.

4. The hand tool of claim 2, wherein said gripping surfaces are straight and smooth.

5. The hand tool of claim 2, wherein said gripping surfaces are V-shaped and smooth, and further have small radiused recesses in the corners of said V-shaped gripping surfaces.

6. The hand tool of claim 1, wherein said means for mounting said adjustable jaw slidably and pivotally on said body comprises a bifurcated section on said adjustable jaw providing two side walls and an inner wall;

a rail section on said body, said rail section being at substantially a 90-degree angle to said fixed jaw, said bifurcated section on said adjustable jaw straddling said rail section;

an elongated slot in said body, said elongated slot being substantially parallel to said rail section; and a pin attached to said side walls of said bifurcated section and extending freely through said elongated slot.

7. The hand tool of claim 1, wherein said means for facilitating the adjustment of said adjustable jaw rapidly toward said fixed jaw comprises a spring having a lower and an upper end, said lower end being attached to an inner wall of a bifurcation in said adjustable jaw, said spring being curved so that said upper end bears against a rail section on said body and holds the top portion of said adjustable jaw away from said rail section and at the same time, urges the bottom portion of said adjustable jaw toward said rail section;

a plurality of first gear teeth formed on said adjustable jaw, each of said first gear teeth having a long flat side and a short flat side, said long flat side being at an acute angle in relation to said rail section and said short flat side being at an obtuse angle in relation to said rail section, both of said sides joining at one end to form a sharply angled tooth; and second gear teeth formed on said pivoting handle, each of said second gear teeth having a long flat side and a short flat side cooperating with said first gear teeth on said adjustable jaw to slide said adjustable jaw toward said fixed jaw as said pivoting handle is moved back and forth away from and toward said fixed handle, while at the same time maintaining parallel alignment between said jaws in an optimum gripping position.

8. The hand tool of claim 1, wherein said means for facilitating the adjustment of said adjustable jaw rapidly away from said fixed jaw comprises raised knobs on opposite sides of said adjustable jaw that may be gripped to pull the bottom portion of said adjustable jaw away from a rail section on said body and separate said first gear teeth on said adjustable jaw from said second gear teeth on said pivoting handle so that said adjustable jaw may be pulled rapidly away from said fixed jaw in one continuous motion.

9. In a hand tool, the combination of a body, a fixed jaw and an adjustable jaw each having a gripping surface, a fixed handle and a pivoting handle, means for mounting said adjustable jaw slidably and pivotally on said body, motivating means for facilitating the closing of said adjustable jaw rapidly toward said fixed jaw while maintaining parallel alignment therewith, and means for facilitating the movement of said adjustable jaw rapidly away from said fixed jaw in a single continuous motion.

10. The hand tool of claim 9, wherein said means for mounting said adjustable jaw slidably and pivotally on said body comprises a rail section formed on said body, said rail section being at substantially a 90-degree angle to said gripping surface on said fixed jaw;

an elongated slot in said body generally in parallel alignment with said rail section;

a bifurcated section on said adjustable jaw forming side walls and an inner wall; and a retaining pin affixed to said side walls of said bifurcated section and inserted pivotally through said elongated slot in said body.

11. The hand tool of claim 9, wherein said motivating means for facilitating the closing of said adjustable jaw rapidly toward said fixed jaw while maintaining parallel alignment therewith comprises a leaf spring having a first end attached to an inner wall of a bifurcated section on said adjustable jaw and a second end bearing against a rail section on said body;

a plurality of first gear teeth on said adjustable jaw, said first gear teeth each having a long flat side and a short flat side cooperating with second gear teeth on said pivoting handle;

said second gear teeth on said pivoting handle each having a long flat side and a short flat side cooperating with said first gear teeth on said adjustable jaw; and a spring disposed between said fixed handle pivoting handle for urging said handles apart and assisting in the rapid opening and closing of handles to move said adjustable jaw toward said fixed jaw and close said jaws on an object.

12. The hand tool of claim 9, wherein said means for facilitating the movement of said adjustable jaw rapidly away from said fixed jaw in a single continuous motion comprises raised knobs on both sides of said adjustable jaw providing finger gripping surfaces for pulling said adjustable jaw outward and downward away from said fixed jaw.

13. The hand tool of claim 9 further having means for easily locking said jaws on an object and means for releasing said jaws from said object.

14. The hand tool of claim 13 wherein said means for easily locking said jaws on said object comprises an open channel extending through said fixed handle;

an arm extending through said open channel, said arm being attached to said pivoting handle;

serrations on one edge of said arm;

a pawl disposed within said channel, said pawl having at least one tooth projecting outwardly therefrom;

a pivot pin inserted through walls of said channel and connected to said pawl; and a lever attached to an outer end of said pivot pin, said lever being used to engage said pawl with said serrations on said arm to lock said jaws on said object.

15. The hand tool of claim 13 wherein said means for releasing said jaws from said object comprises a spring with one end attached to a pawl and another end attached to a pin in said fixed handle, said spring being biased so as to release said pawl from engagement with serrations on an arm extending through a channel in said fixed handle when said handles are squeezed together, thereby releasing said jaws from said object.

16. In a hand tool having a body, a fixed jaw and an adjustable jaw, a fixed handle and a pivoting handle, means for mounting said adjustable jaw on said body, means for facilitating the adjustment of said adjustable jaw rapidly toward said fixed jaw, means for facilitating the adjustment of said adjustable jaw away from said fixed jaw, means for locking said jaws on an object, and means for unlocking said jaws from said object.

17. The hand tool of claim 16, wherein said means for mounting said adjustable jaw on said body comprises:

a bifurcated section on said adjustable jaw;

a rail section on said body, said bifurcated section straddling said rail section;

an elongated slot in said body; and a pin attached to said bifurcated section and extending freely through said elongated slot.

18. The hand tool of claim 16, wherein said means for facilitating the adjustment of said adjustable jaw rapidly toward said fixed jaw comprises a spring with its lower end attached to an inner wall of a bifurcated section in said adjustable jaw, said spring being curved so that its upper end bears against a rail section on said body and holds the top portion of said adjustable jaw away from said rail section and at the same time urges the bottom portion of said adjustable jaw toward said rail section;

a plurality of first gear teeth formed on said adjustable jaw, each of said first gear teeth having a long flat side and a short flat side, said long flat side being at an acute angle in relation to said rail section and said short flat side being at an obtuse angle in relation to said rail section, both of said sides joining at one end to form a sharply angled tooth; and second gear teeth formed on said pivoting handle, said second gear teeth each having a long flat side and a short flat side cooperating with said first gear teeth on said adjustable jaw to jack said adjustable jaw toward said fixed jaw when said pivoting handle is pivoted back and forth in relation to said fixed handle.

19. The hand tool of claim 16, wherein said means for locking said jaws on said object comprises an open channel in said fixed handle;

an arm attached to said pivoting handle and extending through said channel;

serrations on said arm;

a locking pawl for engaging said serrations;

a pin holding said locking pawl within said channel in close proximity to said arm; and a lever attached to an outer end of said pin.

20. The tool in claim 16, wherein said means for unlocking said jaws from said object comprises a spring attached to a toothed pawl, said spring being biased so as to pull said pawl out of engagement with a serrated arm when said handles are pressed forcefully together, so as to release frictional contact between said pawl and said serrated arm.

* * * * *